US009511911B1

(12) United States Patent
Chang et al.

(10) Patent No.: US 9,511,911 B1
(45) Date of Patent: Dec. 6, 2016

(54) RECLOSABLE BAG WITH HEADER

(71) Applicant: Inteplast Group, Ltd., Livingston, NJ (US)

(72) Inventors: Li-Yung Chang, Morristown, NJ (US); Hsiaolei Li, Warren, MI (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 15/011,194

(22) Filed: Jan. 29, 2016

(51) Int. Cl.

| | |
|---|---|
| ***B65D 30/00*** | (2006.01) |
| ***B65D 51/24*** | (2006.01) |
| ***B65D 33/00*** | (2006.01) |
| ***B65D 33/14*** | (2006.01) |
| ***B65D 33/25*** | (2006.01) |

(52) U.S. Cl.
CPC ..... *B65D 51/245* (2013.01); *B65D 33/001* (2013.01); *B65D 33/14* (2013.01); *B65D 33/2591* (2013.01)

(58) Field of Classification Search
CPC ..... B65D 33/001
USPC .. 383/37, 203, 204, 63, 64, 61.1, 61.2, 5, 9; 206/554
See application file for complete search history.

(56) References Cited

U.S. PATENT DOCUMENTS 4,824,261 A * 4/1989 Provost ..... A44B 18/00 24/306
5,014,852 A * 5/1991 Herrington ..... B65D 85/62 206/460
5,048,692 A * 9/1991 Handler ..... B65D 33/2533 383/113
5,100,000 A * 3/1992 Huseman ..... B65D 33/2508 206/554
5,419,437 A * 5/1995 Huseman ..... B65B 43/26 206/554
5,682,730 A 11/1997 Dobreski
5,931,581 A * 8/1999 Garberg ..... B31B 19/62 383/62
6,149,302 A * 11/2000 Taheri ..... B65D 33/2541 383/203
7,036,987 B2 5/2006 Crunkleton et al.
7,097,358 B2 * 8/2006 Keith ..... B65D 33/007 383/13
7,134,788 B2 * 11/2006 Hsiang ..... B65D 33/001 383/64
7,506,487 B2 * 3/2009 Eads ..... B31B 19/36 383/203
7,806,594 B2 * 10/2010 Trinko ..... B65D 33/001 206/554
8,092,088 B2 1/2012 Keith et al.
9,035,121 B1 * 5/2015 Goodsell ..... B65F 1/002 588/249.5

(Continued)

*Primary Examiner* — Jes F Pascua
(74) *Attorney, Agent, or Firm* — Senniger Powers LLP

(57) ABSTRACT

A bag has a bag body that defines an interior and opening. A reclosable closure is configured for repeatably and non-destructively closing and opening the opening. A covering flap is connected to the bag body, extends away from the bag opening, and has a zone of weakness. The covering flap can be attached to the bag body while covering the closure. To access the closure, the covering flap is torn along its zone of weakness. The bag can also have a removable panel, which can be attached to the removable panels of other bags to form a header pack. The bag body and covering flap can be removed from the header pack by being torn along another zone of weakness between the covering flap and removable panel that has a lower tear strength that the zone of weakness of the covering flap.

17 Claims, 5 Drawing Sheets

(56) References Cited

U.S. PATENT DOCUMENTS

| | | | | |
|---|---|---|---|---|
| 2006/0072859 | A1* | 4/2006 | Melchoir | B65D 33/2591 383/64 |
| 2007/0110340 | A1 | 5/2007 | Buchman | |
| 2008/0044110 | A1* | 2/2008 | Garger | B65D 31/10 383/5 |
| 2009/0229717 | A1* | 9/2009 | Halseth | B65D 33/001 150/165 |

* cited by examiner

RECLOSABLE BAG WITH HEADER

FIELD

The present disclosure generally relates to a reclosable bag having a header and, more specifically, to a bag with features for accessing a closure of the bag after the closure is covered with a portion of a header.

BACKGROUND

Reclosable bags are commonly used to hold and enclose food and other products. In one application, reclosable bags are used for portioning merchandise at the site of sale. For example, at a deli counter or grocery store, portions of food are weighed, enclosed in a reclosable bag (e.g., a zippered deli bag), and marked with a sale price. When food or other merchandise is packaged in this manner, it is beneficial to provide customers with confidence that the contents of the bag are protected in the packaging. For example, where the price of the merchandise is a function of weight, a customer should have confidence that none of the contents of the bag were removed after packaging. Likewise, it may be important for a customer to know that the contents of the bag have not been touched by an unauthorized person, which could potentially contaminate the merchandise.

There are at least two ways of providing a customer certainty that the contents of a bag have not been manipulated after packaging. One way is to package the merchandise while the customer is watching and immediately deliver the package over to the customer. This provides the customer with firsthand knowledge of the entire chain of control of the bagged merchandise. Another way to offer a customer certainty is to use features that provide evidence of tampering. In one example, an adhesive seal is placed over the reclosable closure to prevent using the closure without first breaking the seal. The seal provides tamper evidence because either the seal or bag must be torn open to access the contents of the bag after packaging. However, when the customer removes the seal, it can cause damage to the bag or leave adhesive residue on the closure that affects the operation of the closure. Thus, after the adhesive seal is removed, the bag may no longer be usable by the customer for storing the food because the bag enclosure is compromised because of damage caused in removing the adhesive seal.

SUMMARY

In one aspect, a bag comprises a bag body having a top edge margin, a bottom edge margin, and opposite first and second side margins. The bag body comprises front and rear panels joined together at the bottom edge margin and the opposite first and second side edge margins to define a bag interior and a bag opening at the top edge margin of the bag body. A reclosable closure at the top edge margin of the bag body is configured to repeatably and nondestructively close and open the bag opening. A header has a first side margin and a second side margin and extends upward from the rear panel at the top edge margin of the bag body to a top edge margin of the header. The header includes a covering flap and a removable panel separated by a separation line. The covering flap extends between the top edge margin of the bag body and the separation line, and the removable panel extends between the separation line and the top edge margin of the header. The header includes a first zone of weakness extending between the first and second side margins of the header generally at the separation line and a second zone of weakness extending between the first and second side margins of the header positioned on the covering flap between the top edge margin of the bag body and the separation line. The second zone of weakness has a higher tear strength than the first zone of weakness whereby the bag body and covering flap can be torn away from the removable panel without tearing the covering flap through the second zone of weakness.

In another aspect, a header pack comprises a plurality of bags. Each of the bags comprises a bag body having a top edge margin, a bottom edge margin, and opposite first and second side margins. The bag body comprises front and rear panels joined together at the bottom edge margin and the opposite first and second side edge margins to define a bag interior and a bag opening at the top edge margin of the bag body. A reclosable closure at the top edge margin of the bag body is configured to repeatably and nondestructively close and open the bag opening. A header has a first side margin and a second side margin and extends upward from the rear panel at the top edge margin of the bag body to a top edge margin of the header. The header includes a covering flap and a removable panel separated by a separation line. The covering flap extends between the top edge margin of the bag body and the separation line and the removable panel extends between the separation line and the top edge margin of the header. The covering flap includes a zone of weakness extending between the first and second side margins of the header at a location spaced apart between the top edge margin of the bag body and the separation line. The removable panels of the plurality of bags are attached to one another to form the header pack.

In another aspect, a method of packaging saleable food in a bag. The bag comprises a bag body having front and rear panels defining a bag interior and a bag opening at a top edge margin of the bag body. A reclosable closure is configured for repeatably and nondestructively closing and opening the bag opening. A covering flap extends upward from the rear panel at the top edge margin of the bag body and has a zone of weakness formed therein. The method comprises placing the food through the bag opening into the bag interior. The bag opening is closed using the reclosable closure to enclose the food in the bag interior. The covering flap is folded over the reclosable closure and the top edge margin of the covering flap is attached to the front panel such that the covering flap covers the reclosable closure and can be torn along the zone of weakness to provide access to the reclosable closure without separating the top edge margin of the covering flap from the front panel of the bag.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
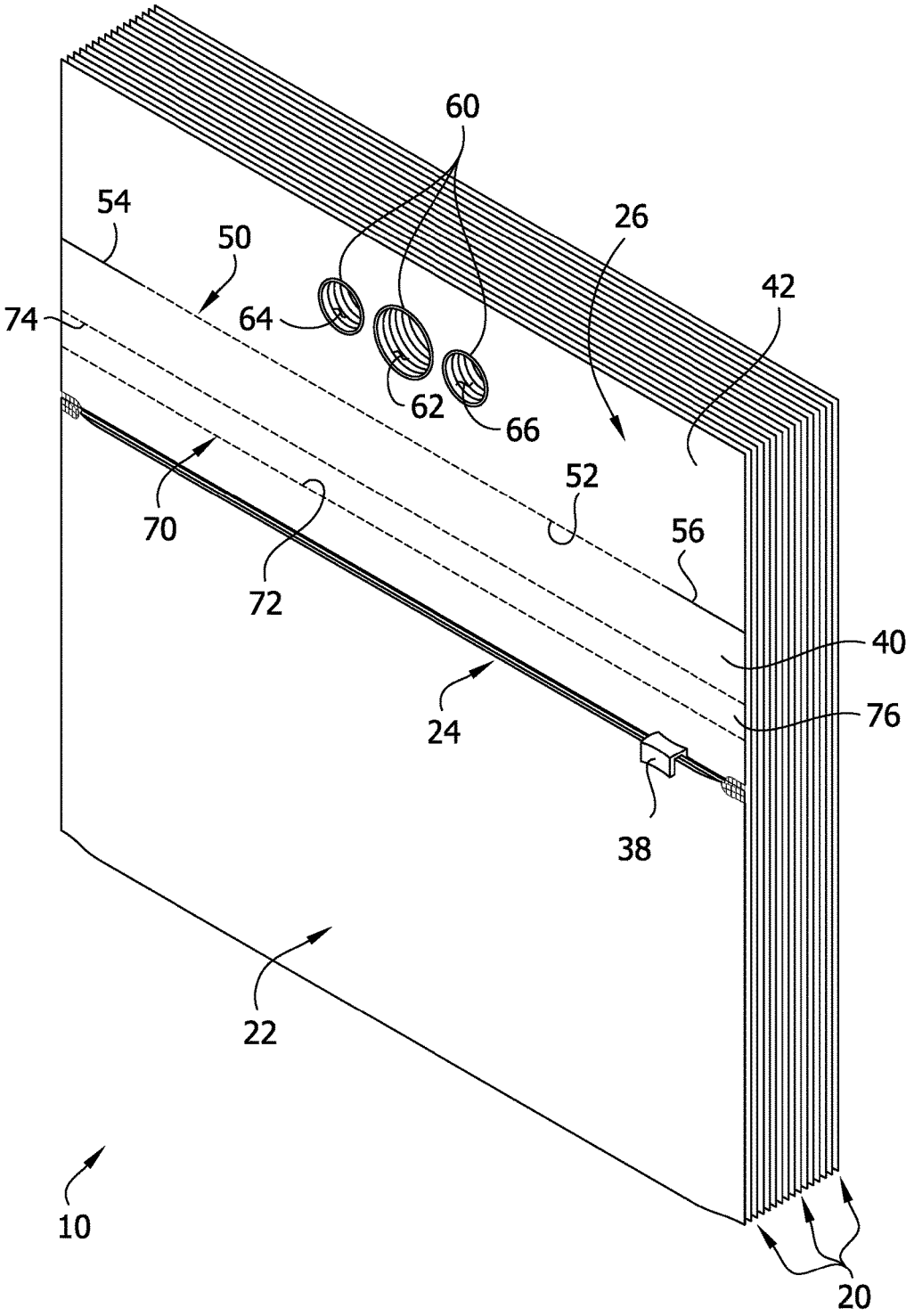
FIG. 1 is a perspective of a header pack comprising a plurality of reclosable bags.

Referring to FIG. 1, a header pack comprising a plurality of reclosable bags 20 is generally indicated at 10. As will be discussed in further detail below, the header pack 10 is suitable for use in packaging merchandise at a retail site. The bags 20 are configured to be removed from the header pack 10, individually filled, and closed. Furthermore, each bag 20 includes a tamper-evident covering for placing over a closure of the bag. After the covering is placed over the closure, access to the closure requires visibly damaging the covering. The tamper-evident coverings include features that allow for tearing open the covering without damaging the bag or the closure. Moreover, the header pack 10 is configured to allow each bag 20 to be removed from the header pack without damaging the tamper-evident covering, even though the tamper evident coverings are configured for being torn open during use.

Figure 2:
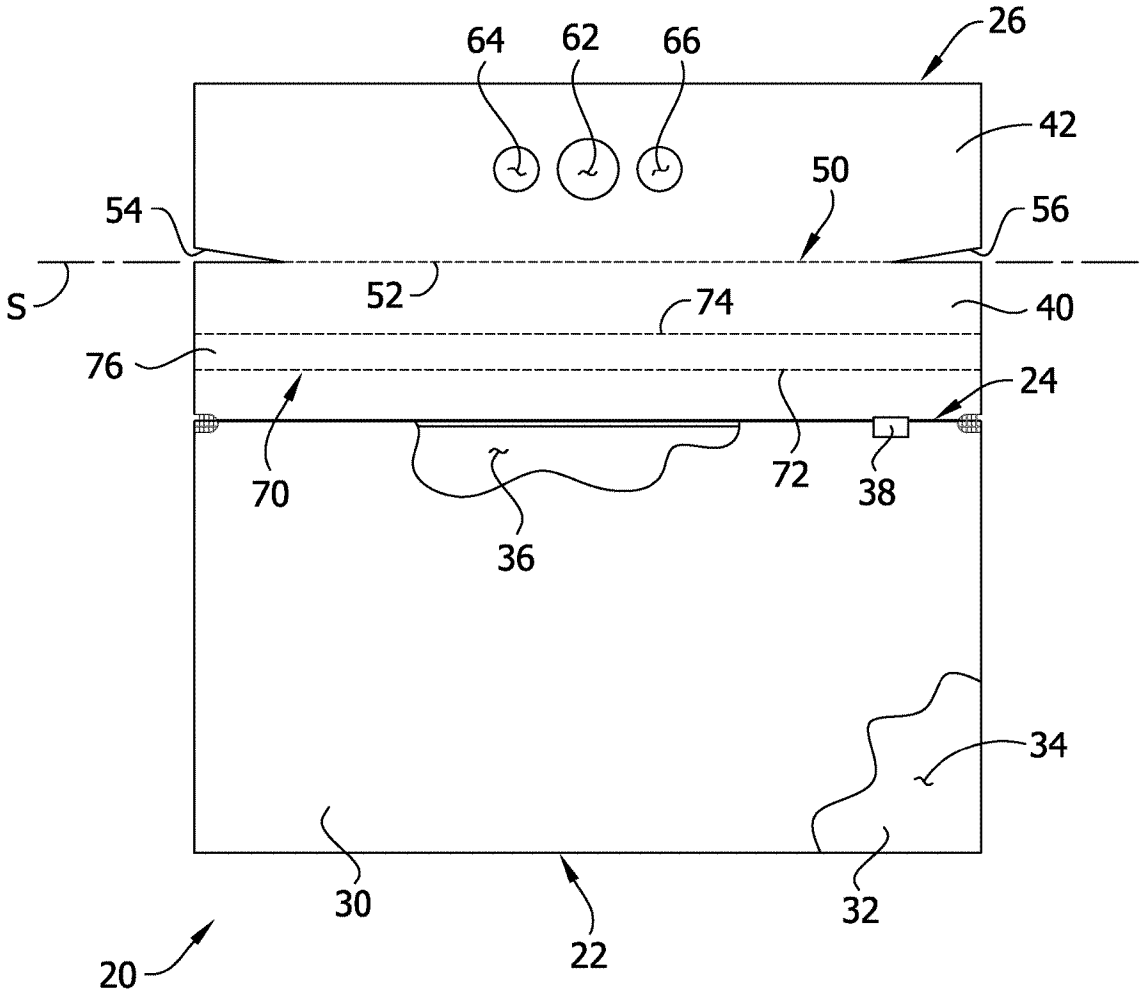
FIG. 2 is a front elevation of one of the reclosable bags partially broken away to reveal a bag interior, bag opening, and a rear panel.

Referring to FIG. 2, each bag 20 includes a bag body 22, a reclosable closure 24, and a header 26. The bag body 22 has a top edge margin, a bottom edge margin, and opposite first and second side margins. The reclosable closure 24 and the header 26 are each joined to the top edge margin of the bag body 22 as discussed in further detail below. The closure 24 is generally aligned with the top edge margin of the bag body 22, and the header 26 extends upward from the top edge margin of the bag body. The bag body 22 includes a front panel 30 and a rear panel 32. The front and rear panels 30, 32 are joined together at the bottom edge margin and the first and second side margins of the bag body 22 but are not joined together along the top edge margin. The front and rear panels 30, 32, therefore, define a bag interior 34 extending between the first and second side margins and top and bottom edge margins of the bag body 22 and a bag opening 36 extending between the first and second side margins at the top edge margin of the bag body.

In the illustrated embodiment, the bag body 22 and header 26 are formed from a single sheet of polymeric film. The sheet of film is folded along the bottom edge margin of the bag body 22 to define the front and rear panels 30, 32 and fused together along the side margins of the bag body to define the bag interior 34. Thus, in certain embodiments, front and rear panels can be "joined" by being formed from a single sheet of material or being separately attached to one another by a fusion bond, adhesive, etc. Likewise, the header 26 can be "joined" to the bag body 22 by being formed of a single piece of material with one or both panels 30, 32 or by being separately attached to one of the panels in any suitable manner. Other ways of constructing the bag 20 may be used within the scope of the present invention. In the illustrated embodiment, the header 26 is contiguous with and extends upward from the rear panel 32 of the bag body 22.

The closure 24 is configured to repeatably and non-destructively close and open the bag opening 36 to permit access to the bag interior 34. In the illustrated embodiment, the closure 24 is a slider closure that comprises front and rear zipper profiles (not shown separately) and a slider 38. In a suitable embodiment, the front and rear zipper profiles extend between the side margins of the bag body 22 in operative alignment with one another at the top edge margin of the bag body. In the illustrated embodiment, the front zipper profile is appended to the front panel 30 at the top edge margin of the bag body 22 and the rear zipper profile is appended to the rear panel 32 at the top edge margin of the bag body. In other embodiments, one or both of the zipper profiles can be formed integrally with the respective bag panel (e.g., using extrusion). The front and rear interlocking profiles are configured for selective interlocking engagement to close the bag. Various interlocking zipper profile shapes are possible, including reclosable closures that define one, two, or more than two pairs of interlocking formations that extend between the first and second side edge margins of the bag body 22. The slider 38 is configured to engage the zipper profiles to close the bag 20 by sliding along the top edge margin of the bag body 22 in a closing direction (e.g., from the first side margin to the second side margin) and to disengage the zipper profiles to open the bag by sliding along the top edge margin of the bag body in an opening direction opposite the closing direction (e.g., from the second side margin to the first side margin). It will be understood that reclosable closures other than slider-type closures (e.g., zipper closures without sliders, adhesive closures, etc.) may also be used without departing from the scope of the invention.

As mentioned above, the header 26 extends upward from the top edge margin of the rear panel 32 to a top edge margin of the header. The header 26 has a first side margin and a second side margin that are respectively aligned with the first and second side margins of the bag body 22. As discussed in further detail below, the header 26 includes a covering flap 40 and a removable panel 42 separated by a separation line S. The covering flap 40 extends between the top edge margin of the bag body 22 and the separation line S, and the removable panel 42 extends between the separation line and the top edge margin of the header 26.

A zone of weakness 50 extends between the first and second side margins of the header 26 generally at the separation line S. As explained below, the zone of weakness 50 is configured to allow the bag body 22 and covering flap 40 to be removed from the header pack 10. In the illustrated embodiment, a line of perforations 52 is formed in the header 26 to define the zone of weakness 50. The perforations 52 lower the tear strength of the header 26 at the zone of weakness 50. Thus, the zone of weakness 50 has a lower tear strength than other portions of the header 26. The line of perforations 52 has a perforation density, which can be measured as a ratio of the cumulative length of all of the perforations in the line (i.e., the sum of the lengths of each of the individual perforations) to the total length of the line of perforations (i.e., the sum of the lengths of each of the individual perforations and the lengths of each of gaps between the perforations). Where perforations of indeterminate length are used (e.g., pin punches), perforation density can be measured as the ratio of the number of perforations to the total length of the line of perforations. Although the illustrated embodiment uses the perforations 52 to form the zone of weakness 50, other ways of lowering the tear strength of the header at the zone of weakness (e.g., embossments, coextruding the zone of weakness from a low tear strength material, etc.) may also be used without departing from the scope of the invention.

In addition to the perforations 52, the zone of weakness 50 includes a first tear initiator 54 that is formed in the header 26 at the first side margin of the header. Likewise, in the illustrated embodiment, the zone of weakness 50 includes a second tear initiator 56 that is formed in the header at the second side margin of the header. In the illustrated embodiment, each of the tear initiators 54, 56 is a slit formed in the header 26. FIG. 2 shows the removable panel 42 pulled upward away from the covering flap 40 and bag body 22 to show the depth of the slits 54, 56. Although first and second tear initiators 54, 56 are used in the illustrated embodiment, other embodiments can include a single tear initiator or no tear initiators without departing from the scope of the invention. Although the slits 54, 56 are used for tear initiators in the illustrated embodiment, in other embodiments, the tear initiators could include notches or other voids or formations that weaken the header at a side edge margin to initiate tearing along the zone of weakness. As discussed in further detail below, the tear initiators 54, 56 help initiate tearing along the zone of weakness 50 when the bag body 22 and the removable panel 42 are pulled apart. In addition, the tear initiators 54, 56 lower the tear strength of the header 26 at the zone of weakness 50.

Referring again to FIG. 1, the zone of weakness 50 is configured to permit separation of the removable panel 42 from the bag body 22 and covering flap 40 when the respective bag 20 is removed from the header pack 10. The bags 20 that form the header pack 10 are joined together at their removable panels 42. More specifically, the illustrated bags 20 are joined together at fusion seals 60 that extend circumferentially around holes 62, 64, 66 in the removable panels 42. Other ways of attaching the removable panels 42 to one another to form the header pack 10 may also be used without departing from the scope of the invention. The holes 62, 64, 66 are configured to receive retainers (e.g., posts, hooks, etc.) of a header pack mount (not shown) to suspend the header pack 10 on the mount so that the bags 20 hang down from the retainers. The retainers are configured to restrain the header pack 10 by holding the removable panels 42 of the bags 20 on the mount. To remove a bag 20 from the header pack 10, a separation force is imparted on the bag body 22 or covering flap 40. When a bag 20 is pulled away from the header pack 10 the seals 60 prevent the removable panel 42 of the selected bag from separating from the other bags in the header pack. Instead, the bag 20 tears along the zone of weakness 50, which separates the bag body 22 and covering flap 40 from the removable panel 42. The seals 60 retain the removable panel 42 on the header pack 10.

Figure 3:
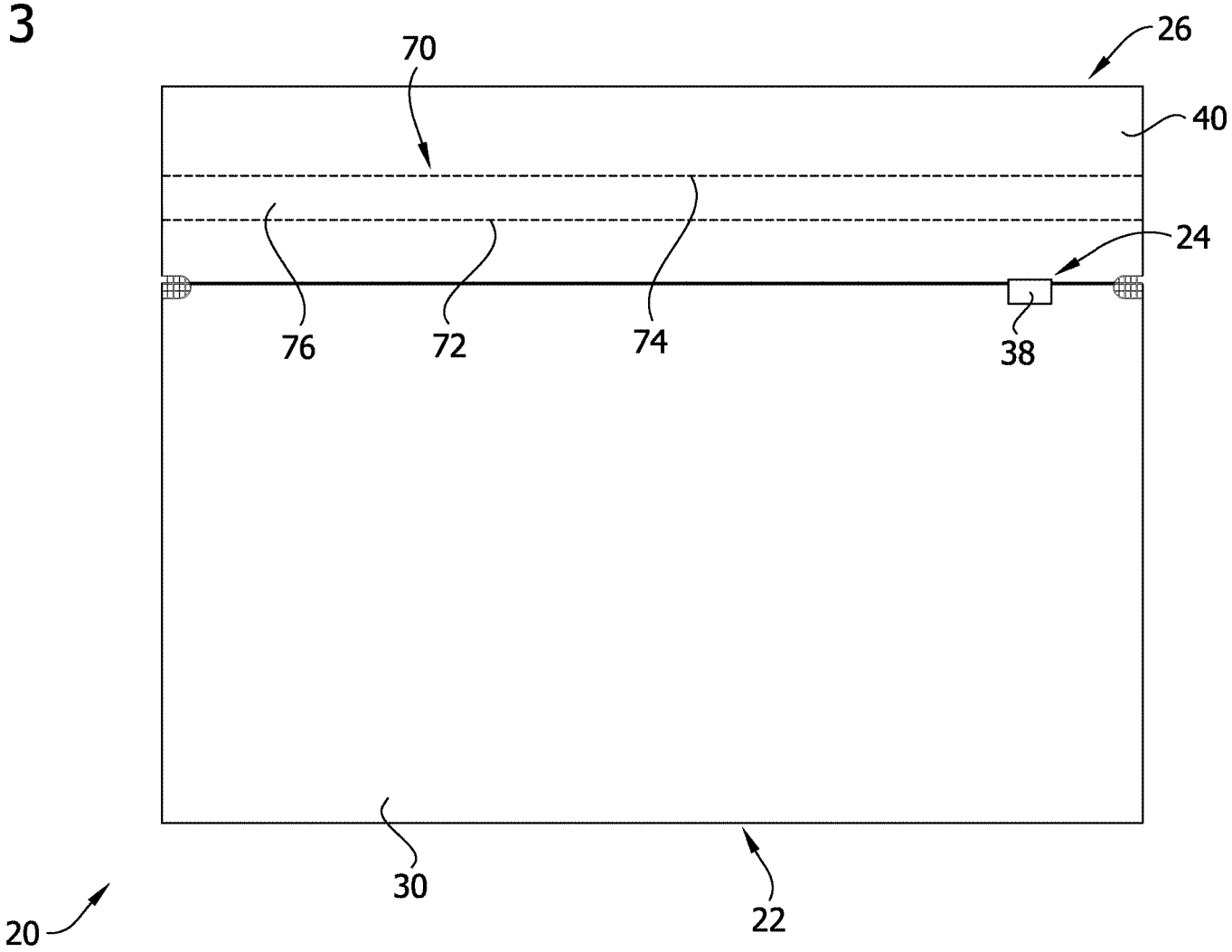
FIG. 3 is a front elevation of the bag of FIG. 2, illustrating the bag after being removed from the header pack.
Figure 4:
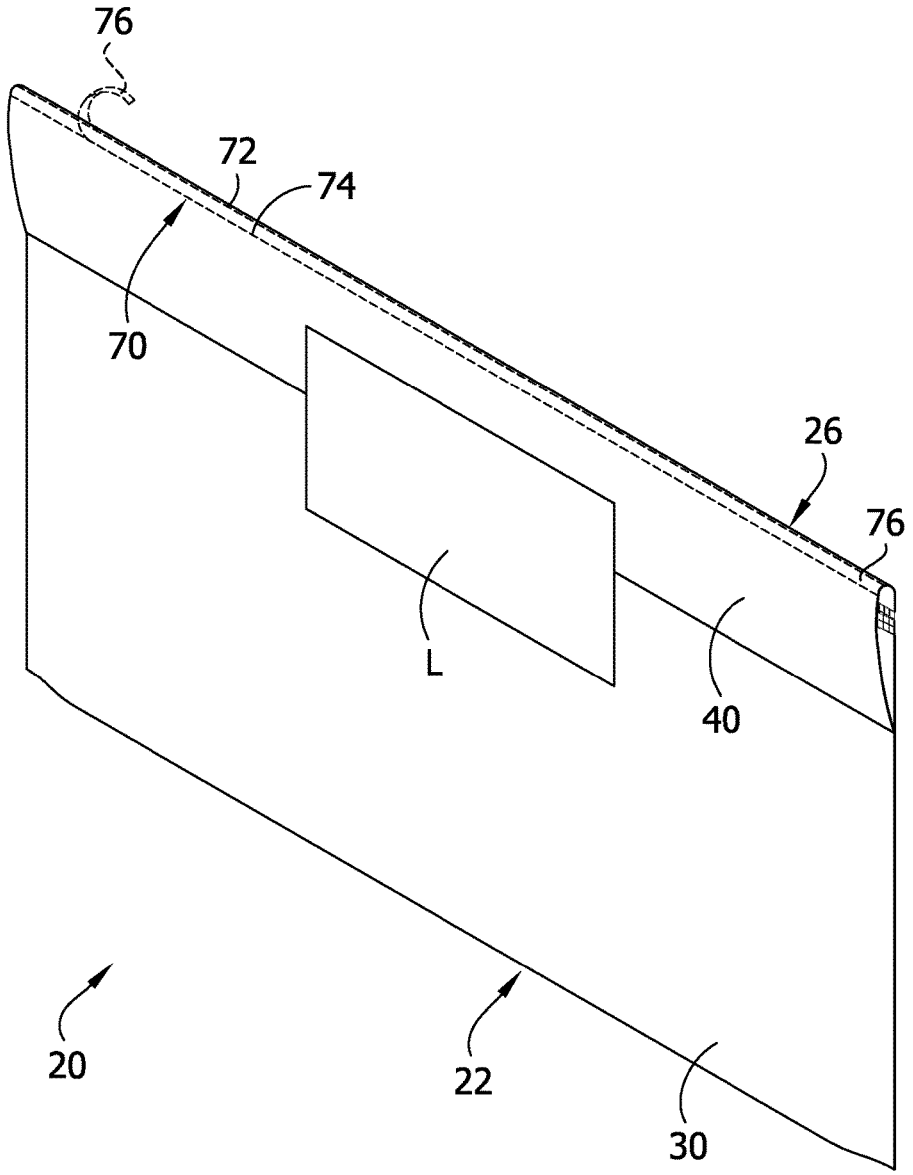
FIG. 4 is a front elevation of the bag of FIG. 2, illustrating the bag closed by a closure and having the closure covered by a covering flap and illustrating a tear strip partially torn away from the covering flap in phantom.

Referring to FIGS. 3 and 4, the covering flap 40 is configured to be folded over the reclosable closure 24 and attached to the front panel 30 to at least partially cover the reclosable closure after the removable panel 42 has been removed. As discussed in further detail below, the covering flap 40 can be folded over the closure 24 and attached to the front panel 30 after the interior 34 of the bag 20 is filled with merchandise and the closure is used to close the bag opening 36. Suitably, the covering flap 40 is configured so that accessing the closure 24 through the covering flap requires tearing the covering flap. In the illustrated embodiment, an adhesive label L is used to secure the covering flap 40 to the front panel 30. Accessing the closure 24 through the engaged covering flap 40 to slide the slider 38 in the opening direction requires tearing of one of the covering flap and label L. This provides visual evidence of when attempts to access the closure 24 through the covering flap 40 are made. Although the illustrated embodiment uses an adhesive label L to secure the covering flap 40 to the front panel 30, other embodiments can secure a covering flap to a front panel in other ways without departing from the scope of the invention. For example, in certain embodiments, the covering flap can include a pressure-sensitive adhesive configured to attach the covering flap to the front panel of the bag when the covering flap is folded over.

The covering flap 40 includes a zone of weakness 70 that extends between the first and second side margins of the header 26 and is configured for opening the covering flap to allow access to the reclosable closure 24. The zone of weakness 70 includes a first line of weakness 72 and a second line of weakness 74 that define a removable tear strip 76. In the illustrated embodiment, each of the first and second lines of weakness 72, 74 is a line of perforations that extends between the first and second side margins of the header 26. In other embodiments, the lines of weakness can be formed in other ways (e.g., by forming a line of embossments, by coextruding a tear strip of low tear strength material, etc.) without departing from the scope of the invention. Moreover, though the illustrated zone of weakness 70 includes two lines of weakness 72, 74 that define a tear strip 76, other zones of weakness can include a single line of weakness or more than two lines of weakness without departing from the scope of the invention.

Figure 2A:
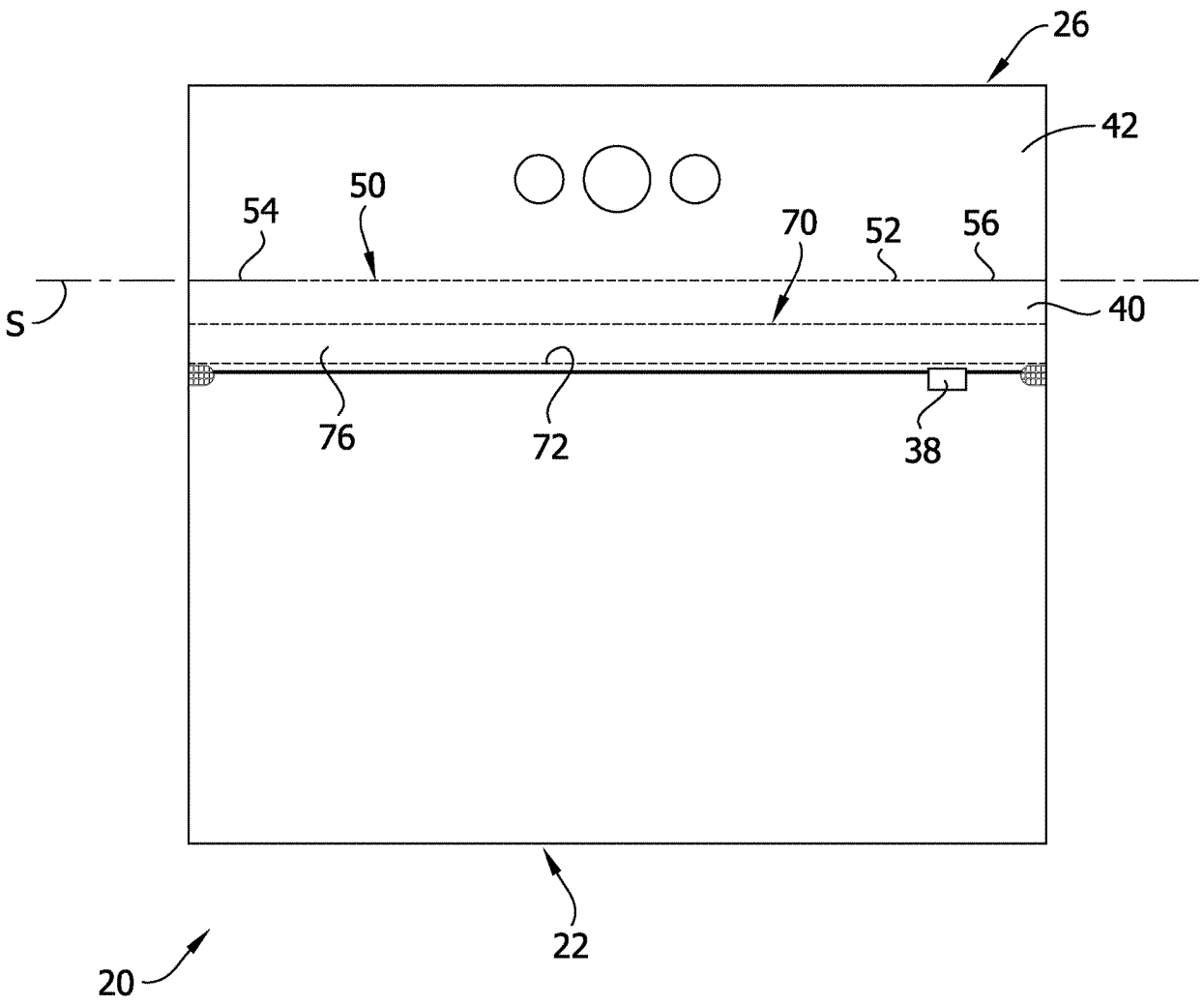
FIG. 2A is a front elevation similar to FIG. 2 of another embodiment of a reclosable bag.

The first and second lines of perforation 72, 74 are positioned on the covering flap 40 to permit a user to tear open the covering flap by gripping the removable tear strip 76 at one side margin of the header 26 and pulling toward the opposite side margin of the header. As shown in FIG. 2, the first line of perforations 72 is spaced apart from the top edge margin of the bag body 22 toward the separation line S and the second line of perforations 74 is spaced apart from the first line of perforations toward the separation line. But as shown in FIG. 2A, in another embodiment, the first line of perforations 72 is generally aligned with the top edge margin of the bag body 22 and the second line of perforations 74 is spaced apart from the first line of perforations toward the separation line S. The perforation lines can be positioned in still other positions on the covering flap without departing from the scope of the invention.

Referring again to FIG. 3, before the covering flap 40 is folded over the closure 24, the tear strip 76 extends vertically from the first line of perforations 72 to the second line of perforations 74. In a suitable embodiment, the tear strip 76 is marked with an indication that notifies a user of the location of the tear strip. As shown in FIG. 4, when the covering flap 40 covers the closure 24, the removable tear strip 76 is located generally above (e.g., in opposing relationship with) the closure. The covering flap 40 is sized so that the label L can adhere the covering flap to the bag wall without interfering with the zone of weakness 70. For example, in certain suitable embodiments, the distance between the separation line S and the line of weakness 72 is at least about 1 inch, preferably from about 1.5 inches to about 3 inches. The covering flap 40 suitably arches over the closure 24 so that user can position a finger between the underside of the covering flap and the closure at a side margin of the header 26 to grip the tear strip 76. Pulling the tear strip 76 from one side margin of the header 26 toward the opposite side margin causes the covering flap 40 to tear along the lines of perforation 72, 74. A partial tear of the tear strip 76 is shown in phantom in FIG. 4. The tear strip 76 can be fully separated from the covering flap 40 if it is torn along the entire length of the zone of weakness 70. After the tear strip 76 is removed, a lower portion of the covering flap (e.g., the portion below the first line of perforations 72 in FIG. 3) remains joined to the rear panel 32 of the bag body 22 and an upper portion of the covering flap (e.g., the portion above the second line of perforations 74 in FIG. 3) remains attached to the front panel 30 of the bag body. But with the tear strip 76 removed, there is a gap between the lower and upper portions of the covering flap 40 through which the user can access the slider 38 (broadly, access the closure 24) to open and close the bag 20.

Without the tear strip 76, a user would be forced to tear either the label or covering flap to access the closure. This could cause inadvertent damage to the bag 10 because of the uncontrolled nature of tearing in the absence of defined tear features. For example, pulling against a label or covering flap without a tear strip might cause the front panel of the bag to tear, which would render the bag unsuitable for reuse. The lines of perforation 72, 74, however, provide a predefined tear structure that ensures controlled tearing of the covering panel 40. The tear strip 76 can be removed without damaging the bag body 22. Thus, the bag 20 is well-suited for reuse after the covering flap 40 is torn open.

Referring again to FIG. 2, the zone of weakness 70 in the covering flap 40 has a higher tear strength than the zone of weakness 50 at the separation line S. The difference in tear strength between the zones of weakness 50, 70 can be facilitated in a number of ways. For example, in the illustrated embodiment, the zone of weakness 70 is free of slits, notches, or other tear initiators, while the zone of weakness 50 includes the first and second tear initiators 54, 56. In other embodiments, the zone of weakness 70 could include a single tear initiator (not shown) or two tear initiators that are less responsive to separation forces than the slits 54, 56 of the zone of weakness 50. For example, if the zone of weakness 70 could include tear initiators (not shown) that are less responsive than the slits 54, 56 to separation forces if the bag 20 would tear along the zone of weakness 50 before tearing along the zone of weakness 70 when a separation force is imparted on the bag body 22 tending to pull the bag body away from the removable panel. One suitable way of forming the zone of weakness 70 to include tear initiators that are less responsive to separation forces than the tear initiators 54, 56 is to include one or two slits that are each shorter than the slits 54, 56. Preferably, the zone of weakness 70 in the covering flap 40 has fewer tear initiators and/or tear initiators that are less responsive than the zone of weakness 50 at the separation line S. As explained below, the use of fewer or less responsive tear initiators is thought to cause the bag 20 to tear at the zone of weakness 50 before tearing at the zone of weakness 70 when pulled from the header pack 10.

Other features may also be used to give the zones of weakness 50, 70 different tear strengths. For example, in the illustrated embodiment, the perforations 52 used to form the zone of weakness 50 are different than the perforations 72, 74 used to form the zone of weakness 70. Like the line of perforations 52, the lines of perforations 72, 74 have a perforation density. In certain embodiments, the perforation density of the line of perforations 52 is greater than the perforation density of the lines of perforations 72, 74. In other embodiments, other parameters of the perforations 52, 72, 74 can be varied to achieve the desired difference in tear strength. Each of the perforations 52, 72, 74 can have a height (as measured along the same axis as the height of the bags). The perforations 52 may have a larger height than the perforations 72, 74. It will be understood that this disclosure describes only a few of the parameters that can be varied to achieve zones of weakness with different tear strengths. Other embodiments can include lines of perforations or other types of zones of weakness that differ in other ways to produce a bag with a first zone of weakness at a separation line that has a higher tear strength than a second zone of weakness that extends along a covering flap.

It is preferable for the zone of weakness 70 to have a higher tear strength than the zone of weakness 50 to prevent damaging the covering flap 40 when removing the bag 20 from the header pack 10. In one embodiment, the bag body 22 and covering flap 40 can be torn away from the removable panel 42 by grasping the bag body at the bottom edge margin thereof and applying a separation force while the removable panel is restrained without tearing the covering flap through the zone of weakness 70. When the bag 20 is pulled away from the header pack 10, the lower tear strength of the zone of weakness 50 causes the bag to tear along the separation line S. This causes the removable panel 42 to separate from the covering flap 40. Because the zone of weakness 70 has a higher tear strength, the covering flap 40 does not tear. When an intact covering flap 40 is folded over the closure 24 and attached to the front panel 30, it provides a reliable indication of tampering; whereas a covering flap that tears as the bag is being removed from the header pack 10 would create confusion about whether the covering flap was tampered with.

An exemplary method of using the header pack 10 in an onsite packaging application will now be briefly described. The method below is described for food retail, but the header pack 10 can also be used in other industries. Moreover, the header pack 10 need not be used for salable merchandise. Rather the bags 20 can be used to package any type of goods or product, whether or not intended for subsequent sale. Although the method below discusses how to use the header pack 10 to package food in a single bag 20, it will be understood that the method can be repeated for each of the bags in the header pack.

Referring to FIG. 1, the header pack 10 may be positioned on a mount (not shown) so that retainers of the mount extend through the holes 62, 64, 66 and suspend the bags 20 from the mount (e.g., restrain the header pack). The bags 20 can be used to package foods for sale, such as deli meats and cheeses. A retailer may price individual portions of the food separately. One method of pricing food portions is to weigh each portion and then determine the price of the portion based on the weight. Thus, in one method of using the header pack 10, a food portion is weighed to determine a price. The food portions can be weighed before or after being packaged in a respective bag 20.

To package the food portions in a bag 20, the retailer removes the bag from the header pack 10 by pulling on the bag. When the retailer pulls on the bag 20 (e.g., imparts a separation force on the bag), the slits 54, 56 initiate tearing of the bag along the zone of weakness 50. Typically, the pulling force will impart a force on the zone of weakness 50 that will cause tearing to begin at one of the slits 54, 56 and travel along the line of perforations 52 until the bag body 22 is separated from the removable panel 42, as shown in FIG. 3. Because the zone of weakness 50 has a lower tear strength than the zone of weakness 70, no tearing occurs at the lines of perforation 72, 74 or elsewhere in the covering flap 40.

After removing the bag 20 from the header pack 10, the retailer opens the reclosable closure 24 if it is not already opened. With the bag 20 opened, the user places the portion of food in the bag interior 34 by passing it through the bag opening 36. When the entire portion is positioned in the bag interior 34, the user closes the reclosable closure 24 by sliding the slider 38 in the closing direction. The closure 24 thereby encloses the portion of food in the bag interior 34.

To provide a tamper-evident structure over the closure 24, the retailer folds the covering flap 40 over the closure and attaches it to the front panel 30, as shown in FIG. 4. In a preferred embodiment, the retailer prints an adhesive label L with weight and/or price information (including, e.g., a bar code) about the portion of food that is packaged in the bag 20. The retailer adheres a portion of the label L to the covering flap 40 and another portion of the label to the front panel 30. Thus, the label L seals the covering flap to the front panel 30 in the folded-over position and also provides pricing information.

After the label L attaches the covering flap 40 to the front panel 30, a customer can have confidence that the packaged food has not been tampered with. Once the covering flap 40 is attached, any access to the food requires breaking one of the bag body 22, covering flap, and label L. Thus it is contemplated that each bag 20 provides an enclosure that can be used by a retailer to package a portion of food on site, but outside of the view of the ultimate purchaser. After the food is packaged in the bag 20, a retailer can place the package in a merchandising display (e.g., a refrigerated display case) where a customer can select from a number of packages of the portioned food. As long as there are no tears in the bag body 22, covering flap 40, and label L, a user can have confidence that no tampering has occurred.

After a customer has made a purchase, he or she can open the bag 22 to access the food. The customer grips the tear strip 76 at one side edge margin of the header 26 and pulls the tear strip toward the opposite side margin. The covering flap 40 tears along both lines of perforations 72, 74, which allows the tear strip 76 to be removed. Once the tear strip 76 is removed, the customer can access the reclosable closure 24 through the gap in the covering flap 40. The customer slides the slider 38 in the opening direction to open the bag 20 and reaches through the opening 36 to retrieve some of the food. If desired, the customer can then slide the slider 38 in the closing direction to reclose the bag 20. The bag 20 can thereby maintain the freshness of the food, even after it is initially opened.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products without departing from the scope of the invention, it is intended that all matter contained in the above description and shown in the accompanying drawings shall be interpreted as illustrative and not in a limiting sense.

What is claimed is:

1. A bag comprising:

a bag body having a top edge margin, a bottom edge margin, and opposite first and second side margins, the bag body comprising front and rear panels joined together at the bottom edge margin and the opposite first and second side edge margins to define a bag interior and a bag opening at the top edge margin of the bag body;

a reclosable closure at the top edge margin of the bag body configured to repeatably and nondestructively close and open the bag opening; and a header having a first side margin and a second side margin and extending upward from the rear panel at the top edge margin of the bag body to a top edge margin of the header, the header including a covering flap and a removable panel separated by a separation line, the covering flap extending between the top edge margin of the bag body and the separation line and the removable panel extending between the separation line and the top edge margin of the header, the header including a first zone of weakness extending between the first and second side margins of the header generally at the separation line and a second zone of weakness extending between the first and second side margins of the header positioned on the covering flap between the top edge margin of the bag body and the separation line, the second zone of weakness having a higher tear strength than the first zone of weakness whereby the bag body and covering flap can be torn away from the removable panel without tearing the covering flap through the second zone of weakness.

2. A bag as set forth in claim 1 wherein the first zone of weakness includes a tear initiator formed in the header at the first side margin thereof.

3. A bag as set forth in claim 2 wherein the first zone of weakness further includes another tear initiator formed in the header at the second side margin thereof.

4. A bag as set forth in claim 1 wherein the first zone of weakness includes at least one tear initiator formed in the header and the second zone of weakness includes fewer tear initiators than the first zone of weakness.

5. A bag as set forth in claim 4 wherein the second zone of weakness is free of tear initiators.

6. A bag as set forth in claim 1 wherein the first and second zones of weakness comprise perforations.

7. A bag as set forth in claim 6 wherein a density of the perforations of the first zone of weakness is greater than a density of the perforations of the second zone of weakness.

8. A bag as set forth in claim 1 wherein the second zone of weakness comprises first and second lines of weakness extending between the first and second side margins of the header, the second line of weakness being spaced apart from the first line of weakness toward the top edge margin of the bag body to define a removable tear strip between the first and second lines of weakness.

9. A bag as set forth in claim 1 wherein the reclosable closure comprises selectively interlockable front and rear zipper profiles and a slider.

10. A bag as set forth in claim 1 wherein the covering flap is configured to be folded over the reclosable closure and attached to the front panel to at least partially cover the reclosable closure after the removable panel has been removed.

11. A header pack comprising a plurality of bags as set forth in claim 1, the removable panels of said bags being attached to one another to form the header pack.

12. A header pack comprising:

a plurality of bags, each of the bags comprising:

a bag body having a top edge margin, a bottom edge margin, and opposite first and second side margins, the bag body comprising front and rear panels joined together at the bottom edge margin and the opposite first and second side edge margins to define a bag interior and a bag opening at the top edge margin of the bag body;

a reclosable closure at the top edge margin of the bag body configured to repeatably and nondestructively close and open the bag opening; and a header having a first side margin and a second side margin and extending upward from the rear panel at the top edge margin of the bag body to a top edge margin of the header, the header including a covering flap and a removable panel separated by a separation line, the covering flap extending between the top edge margin of the bag body and the separation line and the removable panel extending between the separation line and the top edge margin of the header, the covering flap including a zone of weakness extending between the first and second side margins of the header at a location spaced apart between the top edge margin of the bag body and the separation line;

the removable panels of the plurality of bags being attached to one another to form the header pack.

13. A header pack as set forth in claim 12 wherein each of the bags is configured to be torn along the separation line to remove the bag from the header pack, the removable panel of each bag remaining attached to the header bag after the bag is removed.

14. A header pack as set forth in claim 12 wherein the zone of weakness of each bag comprises first and second lines of weakness extending between the first and second side margins of the header, the second line of weakness being spaced apart from the first line of weakness toward the top edge margin of the bag body to define a removable tear strip therebetween.

15. A header pack as set forth in claim 12 wherein perforations are formed in each header at the separation line and the zone of weakness.

16. A header pack as set forth in claim 15 wherein a density of the perforations formed in each header at the separation line is greater than a density of the perforations formed in each header at the zone of weakness.

17. A header pack as set forth in claim 12 wherein each header includes a tear initiator formed in at least one of the first and second side margins thereof at the separation line.

* * * * *